US009384371B2

(12) United States Patent
Al-Suhaibani et al.

(10) Patent No.: US 9,384,371 B2
(45) Date of Patent: Jul. 5, 2016

(54) COMPACT CMOS CURRENT-MODE ANALOG MULTIFUNCTION CIRCUIT

(71) Applicant: KING FAHD UNIVERSITY OF PETROLEUM AND MINERALS, Dhahran (SA)

(72) Inventors: Eyas Saleh Al-Suhaibani, Dhahran (SA); Munir A. Al-Absi, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 123 days.

(21) Appl. No.: 14/526,474

(22) Filed: Oct. 28, 2014

(65) Prior Publication Data

US 2016/0117527 A1 Apr. 28, 2016

(51) Int. Cl.
*G06G 7/44* (2006.01)
*G06G 7/16* (2006.01)

(52) U.S. Cl.
CPC ..... *G06G 7/16* (2013.01)

(58) Field of Classification Search
CPC ..... G06G 7/12; G06G 7/16
See application file for complete search history.

(56) References Cited

U.S. PATENT DOCUMENTS

| | | | | |
|---|---|---|---|---|
| 5,864,255 | A | 1/1999 | Kwok et al. | |
| 5,966,040 | A | 10/1999 | Gai et al. | |
| 6,201,430 | B1 | 3/2001 | Hagino et al. | |
| 8,421,541 | B2 | 4/2013 | Sengupta et al. | |
| 8,575,971 | B1 * | 11/2013 | Chamakura | G05F 1/10 327/103 |
| 8,610,486 | B1 | 12/2013 | Al-Absi et al. | |
| 2011/0050319 | A1 | 3/2011 | Wong | |

FOREIGN PATENT DOCUMENTS

| | | |
|---|---|---|
| JP | 5-54158 | 3/1993 |
| TW | 449718 | 8/2001 |

* cited by examiner

*Primary Examiner* — Hai L Nguyen
(74) *Attorney, Agent, or Firm* — Richard C. Litman

(57) ABSTRACT

The compact CMOS current-mode analog multifunction circuit is based on an implementation using MOSFETs operating in a sub-threshold region and forming two overlapping translinear loops capable of performing multiplication, division, controllable gain current amplifier, current mode differential amplifier, and differential-input single-output current amplifier.

8 Claims, 7 Drawing Sheets

COMPACT CMOS CURRENT-MODE ANALOG MULTIFUNCTION CIRCUIT

BACKGROUND OF THE INVENTION

1. Field of the Invention

The present invention relates to electronic function circuits, and particularly to a compact CMOS current-mode analog multifunction circuit operating in the weak inversion region.

2. Description of the Related Art

Low power and low voltage current-mode analog computational circuits got an increasing interest lately especially as CMOS fabrication technology advances. Using current-mode circuits, many functions can be design with less number of components compared to the voltage-mode counterpart. Nowadays, low voltage and ultra-low power analog circuits are becoming mandatory in battery powered applications. CMOS circuits operating in subthreshold region can be used to realize a low voltage and low power circuits. Multiplication and division are important analog signal processing functions. Having such circuits that consumed very low power is a great advantage. That is because they can be used in portable devices especially devices that are to be used in remote areas. There are many approaches reported in the literature to design multiplier, squaring, square rooter and divider circuits.

Although there are many proposed circuits for current-mode analog multipliers and dividers, many of them are designed to work only as multipliers and dividers. Having a single circuit that can perform more than one function is preferable.

Thus, a compact CMOS current-mode analog multifunction circuit solving the aforementioned problems is desired.

SUMMARY OF THE INVENTION

The compact CMOS current-mode analog multifunction circuit is based on an implementation using MOSFETs operating in a sub-threshold region to form translinear loops.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
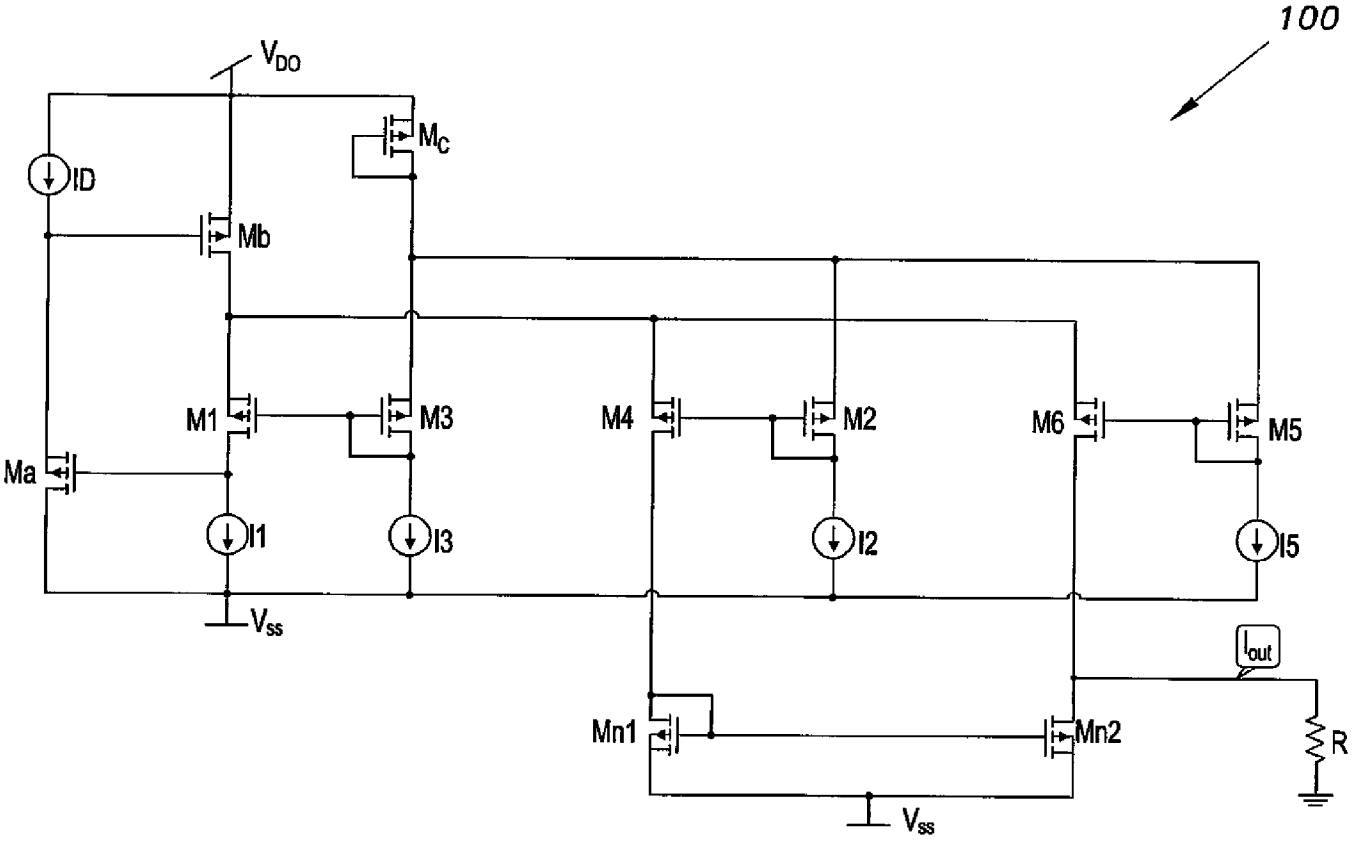
FIG. 1 is a circuit diagram of the CMOS current-mode analog multifunction circuit according to the present invention.

The compact CMOS current-mode analog multifunction circuit 100 (shown in FIG. 1) is based on an implementation using MOSFETs operating in a sub-threshold region to form translinear loops. The circuit 100 consists of six-matched transistors that form two overlapping translinear loops. In circuit 100, the first transistor loop is formed by the transistors M1, M2, M3, and M4. The second translinear loop is formed by the transistors M1, M2, M5, and M6. By modifying the input currents, the present circuit can be used to implement many functions. With reference to FIG. 1, the equation around the translinear loop formed by transistors $M_1$, $M_2$, $M_3$ and $M_4$ is given by:

$$I_1I_2=I_3I_4. \tag{1}$$

And the translinear loop formed by transistors $M_1$, $M_2$, $M_5$ and $M_6$ is given by:

$$I_1I_5=I_3I_6, \tag{2}$$

where, $I_i$ is the drain current for the transistor $M_i$. Let $I_4$ be the output of the first translinear loop and $I_6$ be the output of the second translinear loop. Then, the difference between the two output currents is considered to be the output of the present circuit. That is:

$$I_{out} = I_4 - I_6 = \frac{I_1(I_2 - I_5)}{I_3} \tag{3}$$

Equation (3) is used to produce different functions as described below.

The present circuit can be used as a four-quadrant multiplier if the currents $I_1$, $I_2$, $I_3$, and $I_5$ are set to the value shown in Table 1.

TABLE 1

| Four-quadrant multiplier<br>Four-quadrant multiplier |
|---|
| $I_1 = I_0 + i_{in1}$<br>$I_2 = I_0 + i_{in2}$<br>$I_3 = I_0$<br>$I_5 = I_0 - i_{in2}$ |

The currents $i_{in1}$ and $i_{in2}$ are AC input signals and they are shifted by a DC quantity, $I_0$. Substituting the above values into equation (3), it is easy to show that:

$$I_4 - I_6 = 2i_{in2} + \frac{2i_{in1}i_{in2}}{I_0} \tag{4}$$

if the $2i_{in2}$ term is subtracted from equation 4, a four-quadrant multiplier can be achieved, and the output current is given by:

$$I_{out} = \frac{2i_{in1}i_{in2}}{I_0} \tag{5}$$

It is very clear that this four-quadrant multiplier can be used as a squaring function if $i_{in1}=i_{in2}=i_{in}$, the output current is given by:

$$I_{out} = \frac{2i_{in}^2}{I_0} \tag{6}$$

The present circuit can also be used as a two-quadrant divider. With reference to equation (3) the term $(I_2-I_5)$ is set to be a pure AC signal, this will be the dividend and the divisor will be $I_3$. In other words, let the currents $I_1$, $I_2$, $I_3$, and $I_5$ be set to the values shown in Table 2.

TABLE 2

| Two-quadrant divider<br>Two-quadrant divider |
|---|
| $I_1 = I_{Gain}$<br>$I_2 = I_0 + i_{in1}$<br>$I_3 = I_{in2}$<br>$I_5 = I_0 - i_{in1}$ |

Then the output will be given by:

$$I_{out} = I_4 - I_6 = 2I_{Gain}\frac{i_{in1}}{I_{in2}} \tag{7}$$

It is clear that equation (7) implements a divide function with controllable gain.

Referring to equation (3), the present circuit can also be used as a current mode differential amplifier. Consider the values shown in Table 3 for the translinear loop currents:

TABLE 3

| Current mode differential amplifier<br>Current Mode Differential Amplifier |
|---|
| $I_1 = I_{Gain1}$<br>$I_2 = I_0 + i_{in1}$<br>$I_3 = I_{Gain2}$<br>$I_5 = I_0 - i_{in2}$ |

The currents $I_1$, and $I_3$ can be used to control the gain of the differential amplifier, the output will be given by:

$$I_{out} = I_4 - I_6 = \frac{I_{Gain1}(i_{in1} - i_{in2})}{I_{Gain2}} \tag{8}$$

Differential-input-single-Output current amplifier is achieved, if the translinear loop currents are set to the values shown in Table 4.

TABLE 4

| Differential input single output current amplifier<br>Differential input single output current amplifier |
|---|
| $I_1 = I_{Gain1}$<br>$I_2 = I_0 + i_{in1}$<br>$I_3 = I_{Gain2}$<br>$I_5 = I_0 - i_{in1}$ |

The output is given by:

$$I_{out} = I_4 - I_6 = 2\frac{I_{Gain1}(i_{in1})}{I_{Gain2}} \tag{9}$$

It is clear that equation (9), implements a differential input single output amplifier with flexible gain control using currents $I_{Gain1}$ and $I_{Gain2}$.

If one of the inputs (e.g., $i_{in2}$) in the differential-input single-output current amplifier is set to zero, then a controllable gain current amplifier is obtained. The translinear loop currents are set according values shown in Table 5.

TABLE 5

| Controllable gain current amplifier<br>Controllable gain current amplifier |
|---|
| $I_1 = I_{Gain1}$<br>$I_2 = I_0 + i_{in1}$<br>$I_3 = I_{Gain2}$<br>$I_5 = I_0$ |

Following the same procedure, the output will be as follows:

$$I_{out} = I_4 - I_6 = \frac{I_{Gain1}(i_{in1})}{I_{Gain2}} \tag{10}$$

Figure 2:
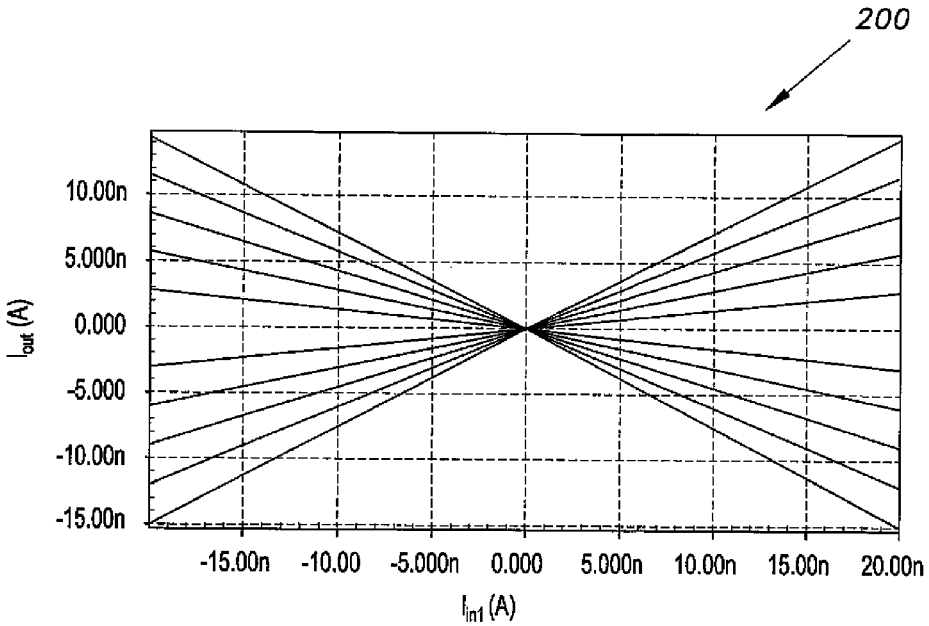
FIG. 2 is a multiplier DC transfer plot of the CMOS current-mode analog multifunction circuit according to the present invention.

Tanner T-spice with 0.35 μm CMOS technology is used to confirm the functionality of the proposed circuit. Table 6 shows the aspect ratios for all transistors used in the simulation. The circuit is operated from ±0.75 DC supply, the input currents for the multiplier are swept from −20 nA to 20 nA. Simulation result shown in plot 200 of FIG. 2 confirms the functionality of the multiplier function.

TABLE 6

Transistor aspect ratios of the present circuit.

| Transistor | $M_a$ and $M_b$ | $M_c$ | $M_1$-$M_6$ | $M_{n1}$-$M_{n2}$ |
|---|---|---|---|---|
| W (μm)/L (μm) | 50/0.4 | 10/0.4 | 9.2/5 | 1.5/4.5 |

Figure 3:
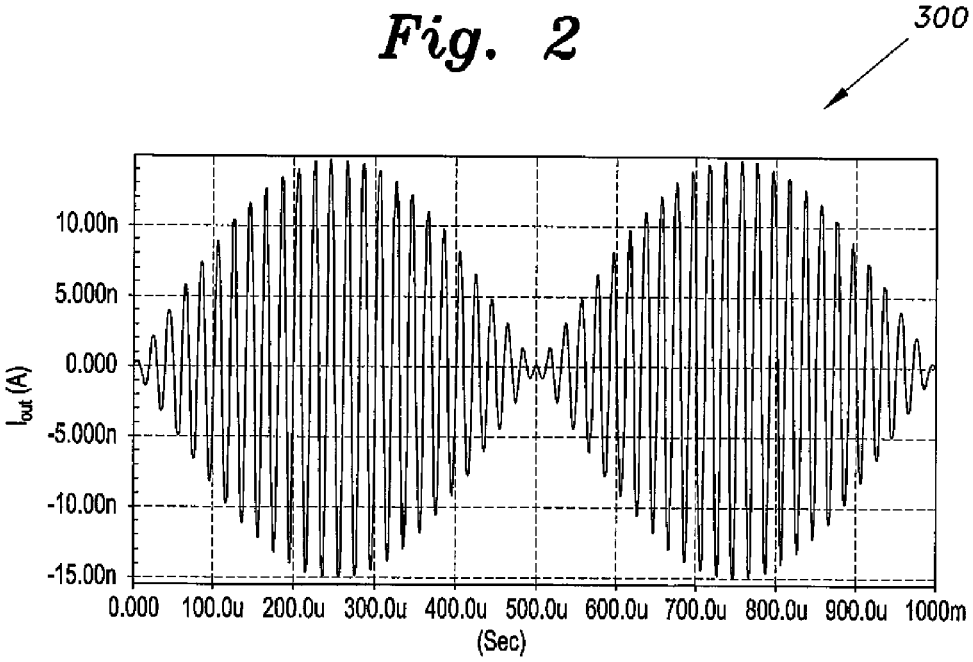
FIG. 3 is a plot of a multiplier as DSBSC AM modulator transfer of the CMOS current-mode analog multifunction circuit according to the present invention.

Application of the multiplier as a double sideband suppressed carrier (DSBSC) modulator was simulated. The simulation result is shown in plot 300 of FIG. 3.

Figure 4:
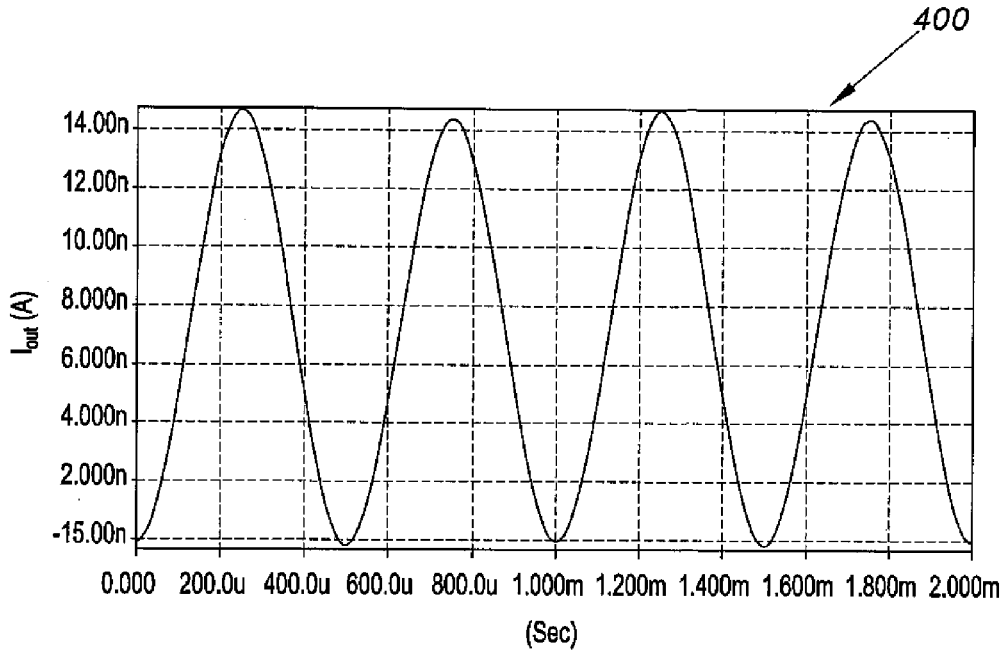
FIG. 4 is a plot of a simulation result for squaring function of the CMOS current-mode analog multifunction circuit according to the present invention.

Plot 400 of FIG. 4 shows the result of a squaring function when an input sinusoidal signal having frequency of 1 kHz and an amplitude of 20 nA is applied. Simulation results confirm the functionality of the circuit.

Figure 5:
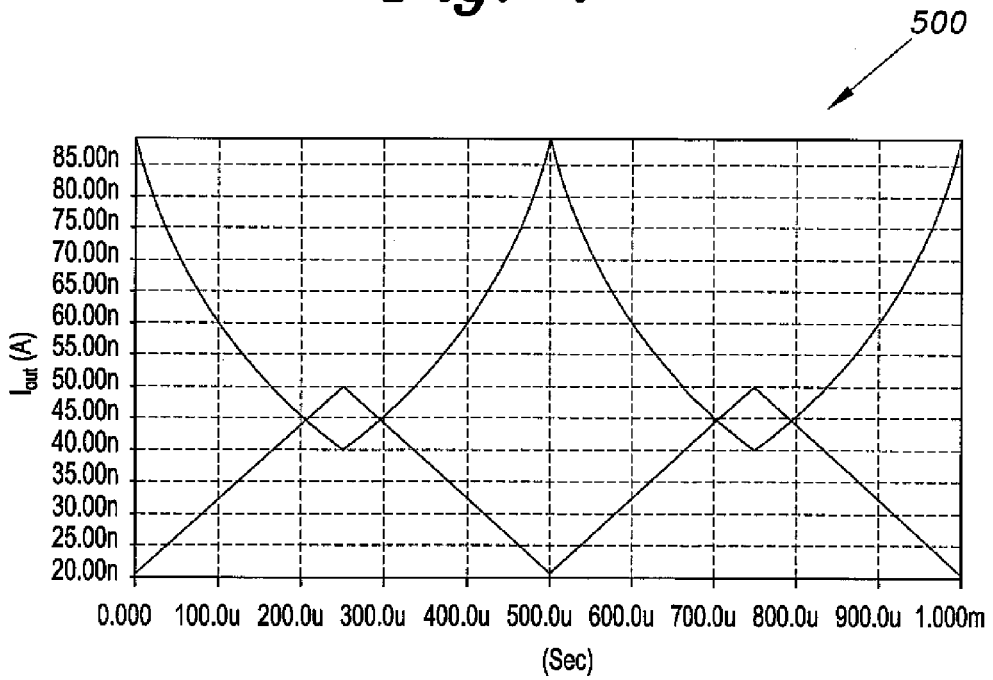
FIG. 5 is a plot of a simulation result for divide function of the CMOS current-mode analog multifunction circuit according to the present invention.
Figure 6:
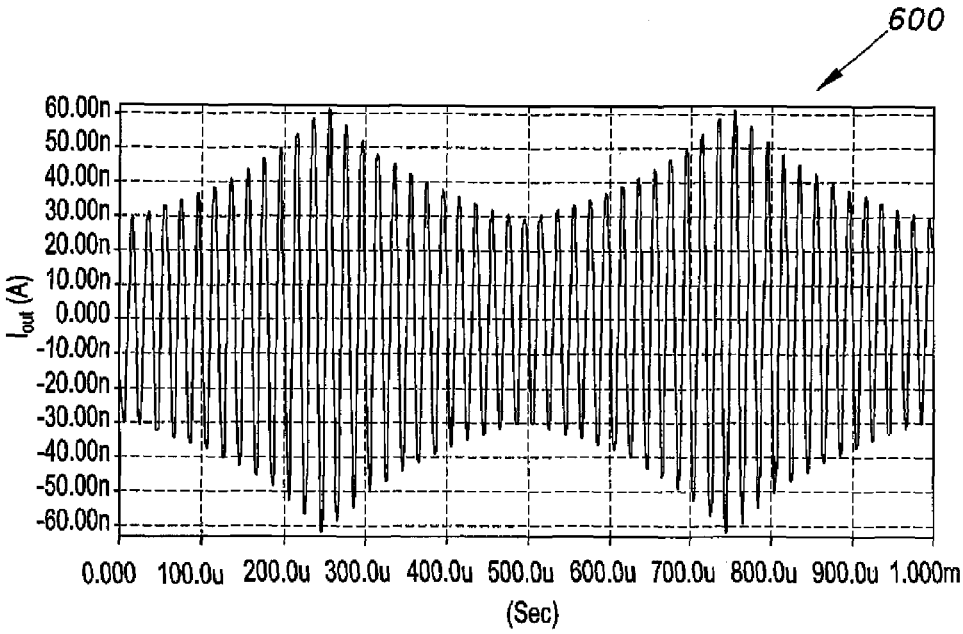
FIG. 6 is a plot showing the result of dividing a sinusoidal signal by a triangular signal using the CMOS current-mode analog multifunction circuit according to the present invention.

Plot 500 of FIG. 5 shows the result of using the present circuit as a two quadrant divider to divide a DC signal by a triangular signal. Also, plot 600 of FIG. 6 shows the result of dividing a sinusoidal signal by a triangular signal.

Figure 7:
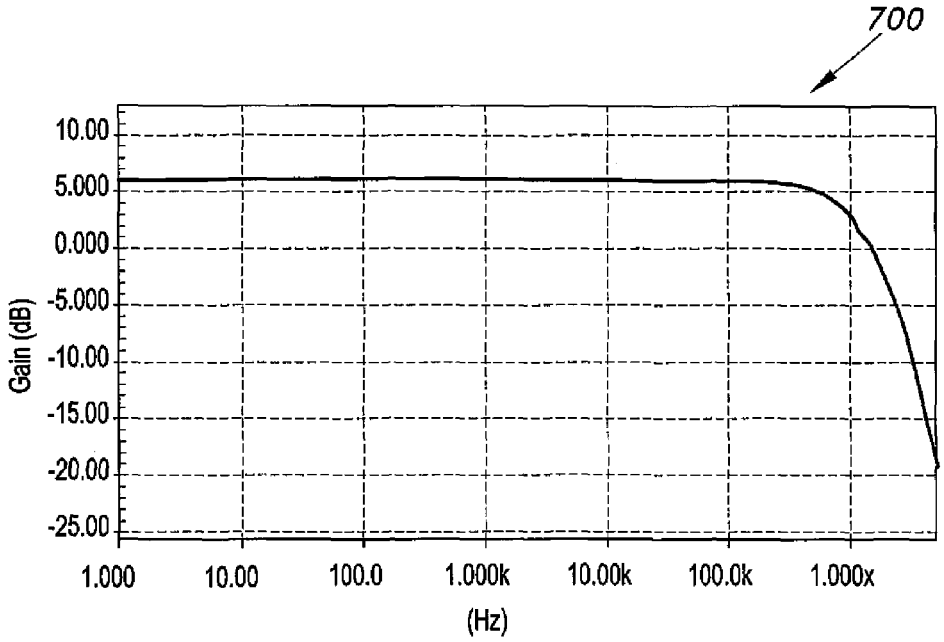
FIG. 7 is a plot of the frequency response of the CMOS current-mode analog multifunction circuit according to the present invention.

Simulation for frequency response was carried out for the multiply function. Simulation result shown in plot 700 of FIG. 7 indicates that the −3 dB frequency is around 1 MHz. The Total Harmonics Distortion (THD) of the proposed circuit was calculated by applying a sine wave signal with frequency of 1 kHz and then calculating the ratio of the power of the 1000 harmonics to the power of the fundamental frequency. The THD came to be 0.13%.

Figure 8A:
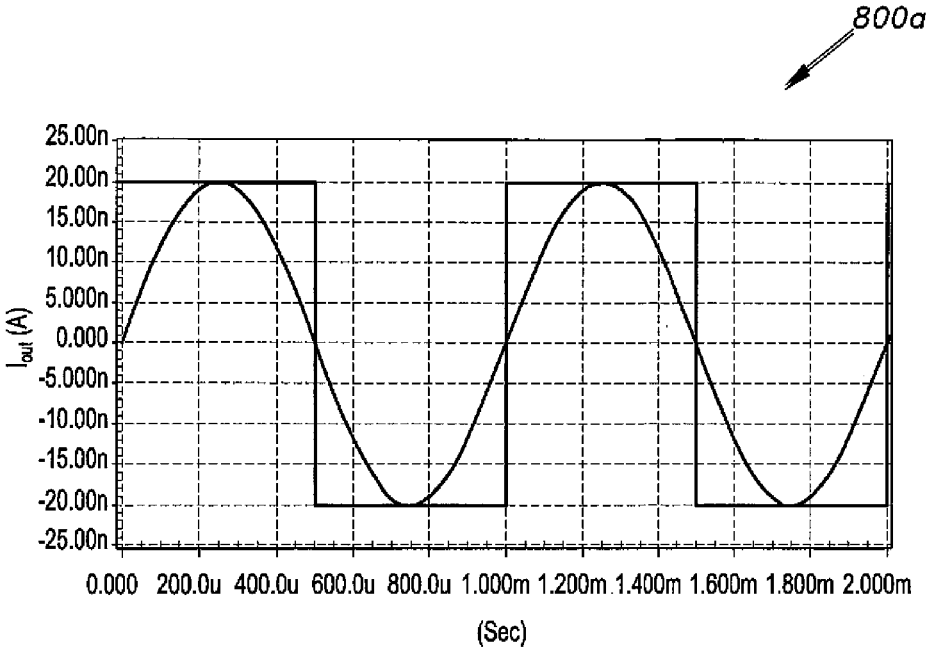
FIG. 8A is a plot of the input signal of the differential amplifier of the CMOS current-mode analog multifunction circuit according to the present invention.
Figure 8B:
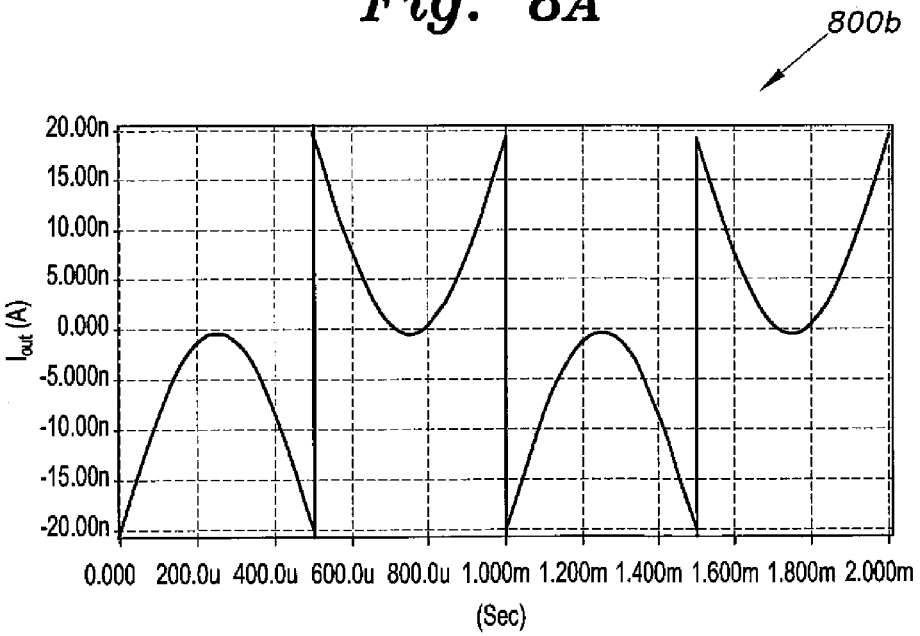
FIG. 8B is a plot of the output signal of the differential amplifier of the CMOS current-Mode Analog multifunction circuit according to the present invention.

Plots 800*a* and 800*b* of FIGS. 8A and 8B, respectively, show the input (FIG. 8A) and output (FIG. 8B) current signals when using the circuit as a difference amplifier. It is clear that the circuit is subtracting the square signal from the sinusoidal one.

Figure 9A:
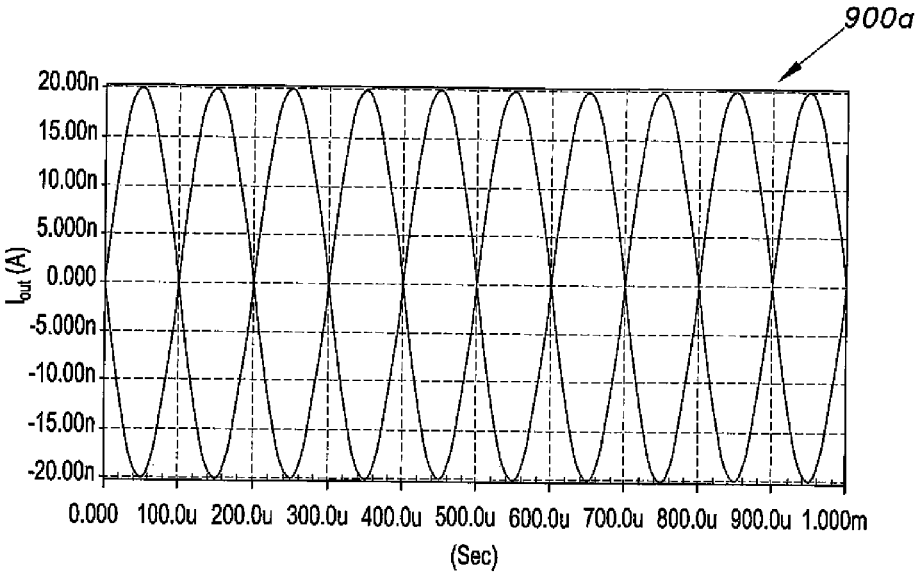
FIG. 9A is another plot of the input signal of a differential input single output amplifier of the CMOS current-Mode Analog multifunction circuit according to the present invention.
Figure 9B:
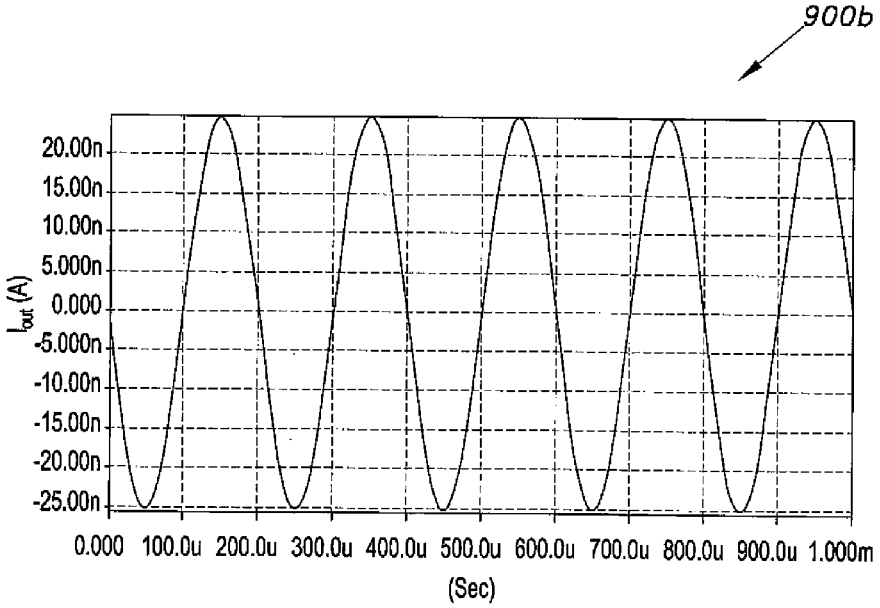
FIG. 9B is another plot of the output signal of a differential input single output amplifier of the CMOS current-Mode Analog multifunction circuit according to the present invention.

The circuit 100 was also simulated for a differential-input single-output current amplifier. The differential input and output signal are shown in plots 900*a* and 900*b* of FIGS. 9A and 9B, respectively.

Figure 10:
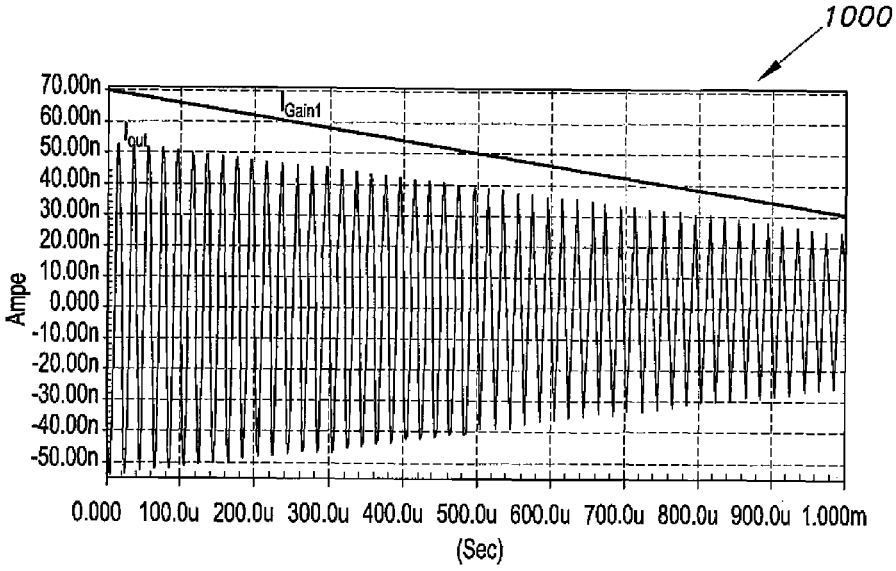
FIG. 10 is a plot of the gain change under a differential input single output amplifier configuration of the CMOS current-Mode Analog multifunction circuit according to the present invention.

Plot 1000 of FIG. 10 shows the simulation result for the output current when $I_{Gain1}$ is varied from 70 nA to 30 nA. It is clear that the gain of the output changes accordingly.

Figure 11:
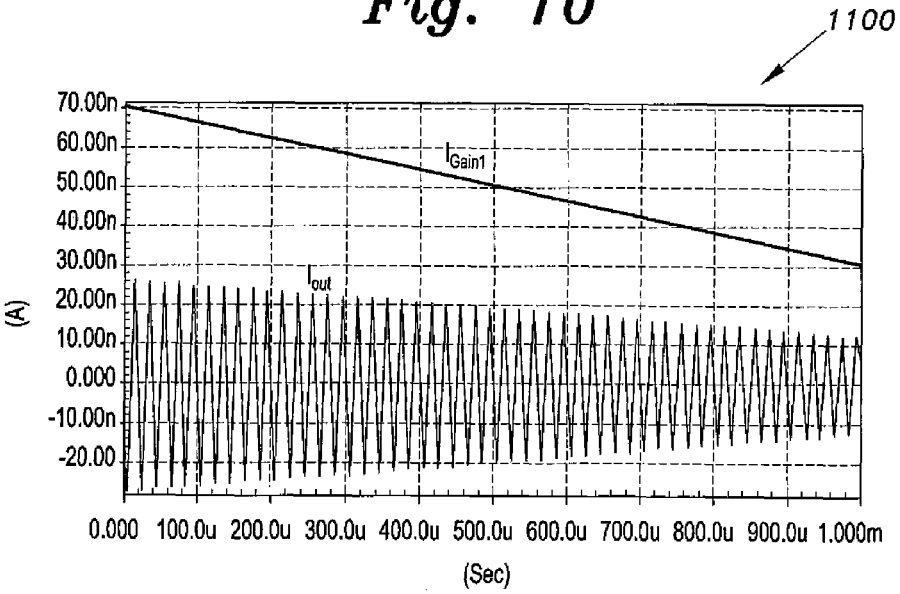
FIG. 11 is a plot of the gain change under a controllable gain current amplifier configuration of the CMOS current-Mode Analog multifunction circuit according to the present invention.

Plot 1100 of FIG. 11 shows the simulation result when using the present circuit as a controllable gain current amplifier. The input is a sinusoidal signal and the gain is controlled by varying $I_{Gain1}$ from 70 nA to 30 nA.

The performance of the present design was compared with previously published work in the open literature and is summarized in Table 7.

TABLE 7

Performance comparison

| Reference | A, Mahmoudi, A. Khoei and KH, Hadidi. (2007) | M. Gravati, M. Valle, G. Ferri, N. Guerrini, L. Reyes, | K. Tanno, Y. Sugahara, H. Tamura. | This work |
|---|---|---|---|---|
| Year | 2007 | 2005 | 2011 | 2013 |
| Power Supply | 2 V | 2 V | 1 V | ±0.75 V |
| Technology | 0.35 μm | 0.35 μm | 0.18 μm | 0.35 μm |
| Bandwidth | <10 MHz | 200 kHz | 768 kHz | 1 MHz |
| THD | <1% | 0.90% | 1.30% | 0.14% |
| Linearity error | 2.8% | 5% | 0.88% | 0.5% |
| Power Consumption | 9 μW | 5.5 μW | 1.12 μW | 1.4 μW |
| Functions | Multiply and divide | Multiply | Multiply | Multiply, divide, and three different types of amplifiers |

It is clear from the table that the present design has a better performance in terms of power consumption, linearity error, and THD, and the number of functions it can implement compared to most of the related designs. Also, its bandwidth is better than most of the other published works. The present circuit 100 implements many functions with less number of transistors compared to other designs.

The present invention provides a new current-mode analog multi-function circuit capable of performing multiplication, division, controllable gain current amplifier, current mode differential amplifier, and differential-input single-output current amplifier. The circuit is compact and can be a useful building block in analog signal processing applications.

It is to be understood that the present invention is not limited to the embodiments described above, but encompasses any and all embodiments within the scope of the following claims.

We claim:

1. A compact CMOS current-mode analog multifunction circuit, comprising:

a first translinear loop comprised of metal-oxide-semiconductor field-effect transistors (MOSFETs) M1, M2, M3, and M4;

a second translinear loop comprised of metal-oxide-semiconductor field-effect transistors (MOSFETs) M1, M2, M5, and M6, first and second translinear loops overlapping and configured to operate in a sub-threshold (weak inversion) region, input $i_{in1}$ of the first translinear loop consisting of at least one drain current of the first translinear loop MOSFETS, input $i_{in2}$ of the second translinear loop consisting of at least one drain current of the second translinear loop MOSFETS;

currents of the first translinear loop being characterized by the relation, $$I_1I_2=I_3I_4,$$

where $I_i$ is the drain current for the transistor $M_i$ and $I_4$ is the output of the first translinear loop;

currents of the second translinear loop being characterized by the relation, $$I_1I_5=I_3I_6,$$

where $I_i$ is the drain current for the transistor $M_i$, and $I_6$ is the output of the second translinear loop;

wherein an output current of the current-mode analog multifunction circuit is a difference between the outputs of the first and second translinear loops.

2. The compact CMOS current-mode analog multifunction circuit according to claim 1, further comprising:

currents in the circuit characterized by the relations, $$I_1=I_0+i_{in1}$$

$$I_2=I_0+i_{in2}$$

$$I_3=I_0$$

and $$I_5=I_0-i_{in2};\text{ and}$$

wherein the input currents $i_{in1}$ and $i_{in2}$ are AC input signals shifted by a DC quantity $I_0$, resulting in a four quadrant multiplication of the input currents at the output of the current-mode analog multifunction circuit after subtracting $2i_{in2}$ from the output current, said currents being characterized by the relations, $$I_4 - I_6 = 2i_{in2} + \frac{2i_{in1}\,i_{in2}}{I_0}$$

-continued $$I_{out} = \frac{2i_{in1}i_{in2}}{I_0}.$$

3. The compact CMOS current-mode analog multifunction circuit according to claim 2, further comprising:

currents in the circuit characterized by the relation, $i_{in1}=i_{in2}=i_{in}$; and wherein the output current is characterized by the relation, $$I_{out} = \frac{2i_{in}^2}{I_0},$$

thereby implementing a squaring function.

4. The compact CMOS current-mode analog multifunction circuit according to claim 1, further comprising:

currents in the circuit characterized by the relations, $I_1=I_{Gain}$, $I_2=I_0+i_{in1}$, $I_3=I_2$, $I_5=I_0-i_{in1}$; and wherein the output current is characterized by the relation, $$I_{out} = I_4 - I_6 = 2I_{Gain}\frac{i_{in1}}{I_{in2}},$$

thereby implementing a divide function with controllable gain.

5. The compact CMOS current-mode analog multifunction circuit according to claim 1, further comprising:

currents in the circuit characterized by the relations, $I_1=I_{Gain1}$, $I_2=I_0+i_{in1}$, $I_3=I_{Gain2}$, $I_5=I_0-i_{in2}$; and wherein the currents $I_1$, and $I_3$ can be used to control the gain of the differential amplifier, the output current being characterized by the relation, $$I_{out} = I_4 - I_6 = \frac{I_{Gain1}(i_{in1} - i_{in2})}{I_{Gain2}},$$

thereby implementing a current mode differential amplifier.

6. The compact CMOS current-mode analog multifunction circuit according to claim 1, further comprising:

currents in the circuit characterized by the relations, $I_1=I_{Gain1}$, $I_2=I_0+i_{in1}$, $I_3=I_{Gain2}$, $I_5=I_0-i_{in1}$; and wherein the output current is characterized by the relation, $$I_{out} = I_4 - I_6 = 2\frac{I_{Gain1}(i_{in1})}{I_{Gain2}},$$

thereby implementing a differential input single output amplifier with flexible gain control using currents $I_{Gain1}$ and $I_{Gain2}$.

7. The compact CMOS current-mode analog multifunction circuit according to claim 1, further comprising:

currents in the circuit characterized by the relations, $i_{in2}=0$, $I_1=I_{Gain1}$, $I_2=I_0+i_{in1}$, $I_3=I_{Gain2}$, $I_5=I_0-i_{in1}$; and wherein the output current is characterized by the relation, $$I_{out} = I_4 - I_6 = \frac{I_{Gain1}(i_{in1})}{I_{Gain2}},$$

thereby implementing a controllable gain current amplifier.

8. The compact CMOS current-mode analog multifunction circuit according to claim 1, wherein the translinear loop MOSFETs M1 through M6 have an aspect ratio of 9.2μ/5μ.

* * * * *